United States Patent [19]

Yuen

[11] Patent Number: 4,947,959

[45] Date of Patent: Aug. 14, 1990

[54] FOLDING LADDER

[76] Inventor: Haison Yuen, 2-1, Jinlon Rd., Joe-Ay Village, Yen-Pu Shian, Pintung Hsien, Taiwan

[21] Appl. No.: 323,392

[22] Filed: Mar. 14, 1989

[51] Int. Cl.[5] ..... E06C 1/28; E06C 7/08

[52] U.S. Cl. ..... 182/22; 182/27; 182/46; 182/163; 182/228

[58] Field of Search ..... 182/163, 166, 21, 27, 182/22, 228, 46; 403/92, 93, 97; 16/344, 331

[56] References Cited

U.S. PATENT DOCUMENTS

| | | | |
|---|---|---|---|
| 2,621,689 | 12/1952 | Fordon | 403/92 X |
| 3,980,157 | 9/1976 | Wrigley | 182/163 |
| 4,666,328 | 5/1987 | Ryu | 182/163 X |
| 4,773,503 | 9/1988 | Purkapile | 182/163 |

FOREIGN PATENT DOCUMENTS

| | | | |
|---|---|---|---|
| 1213970 | 4/1966 | Fed. Rep. of Germany | 182/228 |
| 2278906 | 7/1974 | France | 182/228 |
| 264096 | 6/1964 | Netherlands | 182/228 |

*Primary Examiner*—Alvin C. Chin-Shue

*Attorney, Agent, or Firm*—Larson and Taylor

[57] ABSTRACT

A folding ladder comprising of four straight sections each consisting of two uprights and four rungs equally spaced. The sections are connected with insulating hinged joints which can be tightened immovable or loosened movable by means of a lever handle thus allowing the adjustment of the ladder into various configurations.

6 Claims, 10 Drawing Sheets

7
7
21
2
21
2
21

31
3
31

31'
3
31'

4
4

FOLDING LADDER

BACKGROUND OF THE INVENTION

This applicant has filed an application for an American patent titled "An Adjustable Folding Ladder", Ser. No. 114,022, which is composed of four straight sections with three pairs of hinged joints. Each section is made up of two uprights as the legs, and connectors and rungs are set horizontally between the uprights for stepping on. Adjoining sections are connected together by two hinged joints right and left. A connector, whose both ends are separately cut with female left-winding or right-winding threads, combines with the screw of the hinged joint so that one-way turning of the connector can tighten or loosen the hinged joints for adjusting the contained angle of the two sections and for changing the height of the ladder or folding the ladder for storage.

This invention concerns another kind of a folding ladder with a different structure from the application of Ser. No. 114,022.

SUMMARY OF THE INVENTION

This invention, a folding ladder, is made up of four straight sections. Each section is made up of two uprights and four rungs spaced equally apart between the two uprights. Two adjoining sections are assembled together with two hinged joints. Each hinged joint comprises of a male hinge and a female hinge. Both hinges are combined together with a bolt penetrating the central round holes in both hinges. A lever handle is connected to the bolt and can be rotated to tighten or loosen the hinged joint. When the lever handle is unlocked, the hinged joint is loosened and allows the adjustment of the angle contained by two adjoining sections. When the required angle is attained, the lever handle is locked to press the female hinge against the male hinge, thus restricting the relative movement between the two hinges.

The folding ladder can be adjusted to become a straight ladder, a reversed V shape or an M shape according to the need of the user.

BRIEF DESCRIPTION OF THE DRAWINGS

This invention will now be described in detail with reference to accompanying drawings wherein:

FIG. 7 is a cross-sectional view taken along line 7—7 of FIG. 6;

DETAILED DESCRIPTION OF THE INVENTION

Figure 1:
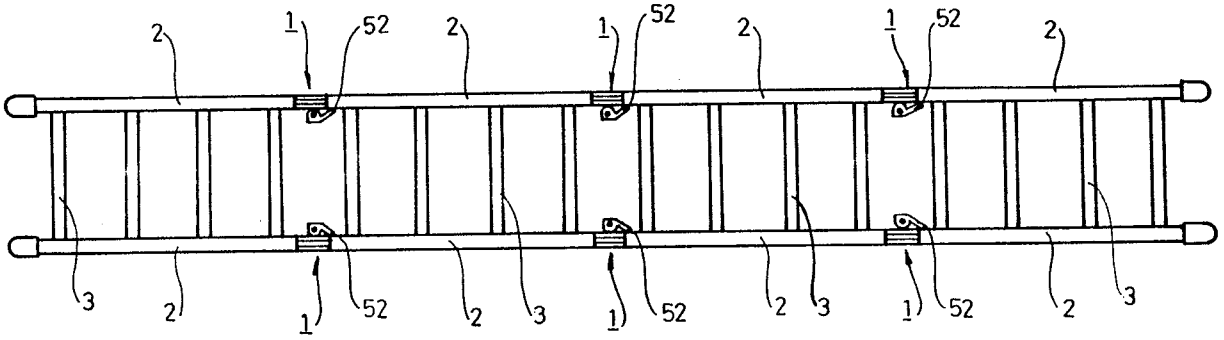
FIG. 1 is a top view of this ladder adjusted to a straight ladder in accordance with the present invention.

This folding ladder comprises of hinged joint 1, uprights 2, and rungs 3 as its main parts as shown in FIG. 1.

The hinged joint 1 consists of a male hinge 11 (FIG. 2) and a female hinge 12 (FIG. 4) made of an insulating material such as plastic.

Figure 3:
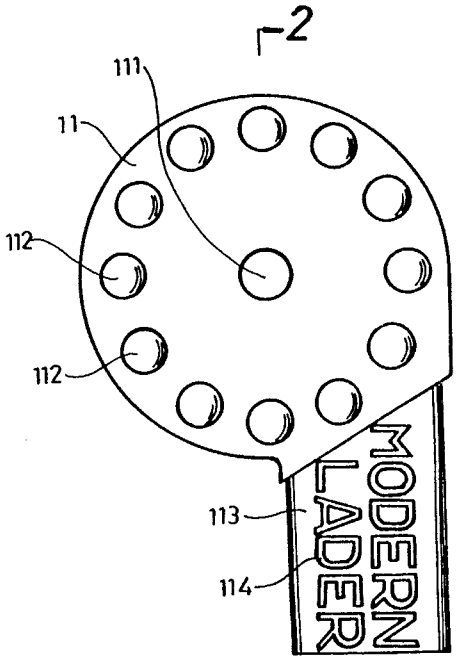
FIG. 3 is a cross-sectional view taken along line 3—3 of FIG. 2.
Figure 2:
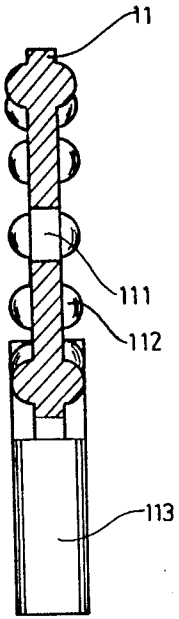
FIG. 2 is a front view of the male hinge in accordance with the present invention.

The male hinge 11 shown in FIGS. 2 and 3 is molded with a central round hole 111 for a combining bolt to penetrate. It has a plurality of protruding hemispheres 112 on the circumference equally spaced apart with said hole 111 as its center, and an arm 113 to insert in the hollow space of the upright 2 to combine the hinged joint 1 with the upright 2. In addition, the arm 113 is indented with words 114 of a trademark or the like on both faces during the process of molding.

Figure 5:
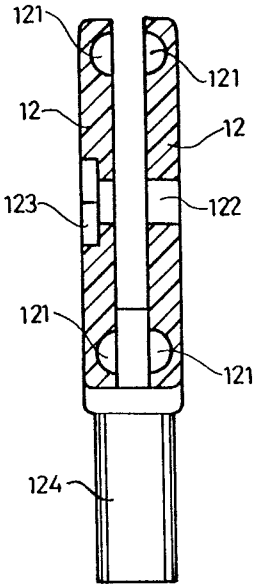
FIG. 5 is a cross-sectional view taken along line 5—5 of FIG. 4.
Figure 4:
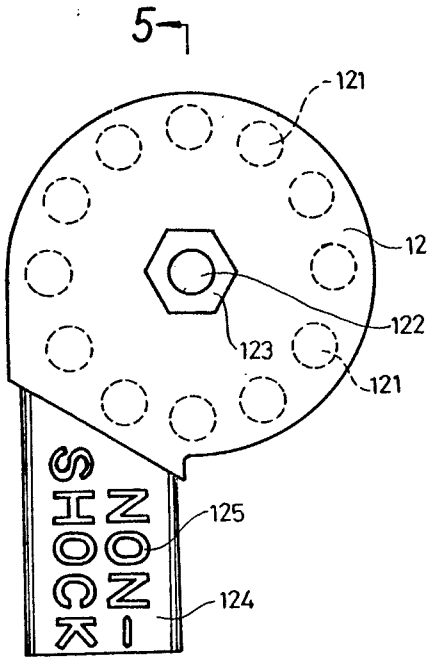
FIG. 4 is a front view of the female hinge in accordance with the present invention.

The female hinge 12 shown in FIGS. 4 and 5 consists of two round sections spaced apart at a distance equal to the thickness of the male hinge 11. The side view of the female hinge is similar to a tuning fork (FIG. 5). The round sections are manufactured with a plurality of dented hemispheric holes 121 on the inner faces for engaging with the corresponding protruding hemispheres 112 of the male hinge 11. The female hinge 12 also has a bolt hole 122 and a counter sunk nut hole 123. A connecting bolt is inserted in the bolt hole after the insertion of the male hinge 11 into the female hinge 12. The female hinge 12 also has an arm 124 for inserting into the hollow space of upright 2 to combine the hinged joint 1 to the upright 2. The arm 124 is made with indented words 125 of a trademark or the like on both sides during the process of molding.

Figures 6, 8, 9, 10, 11:
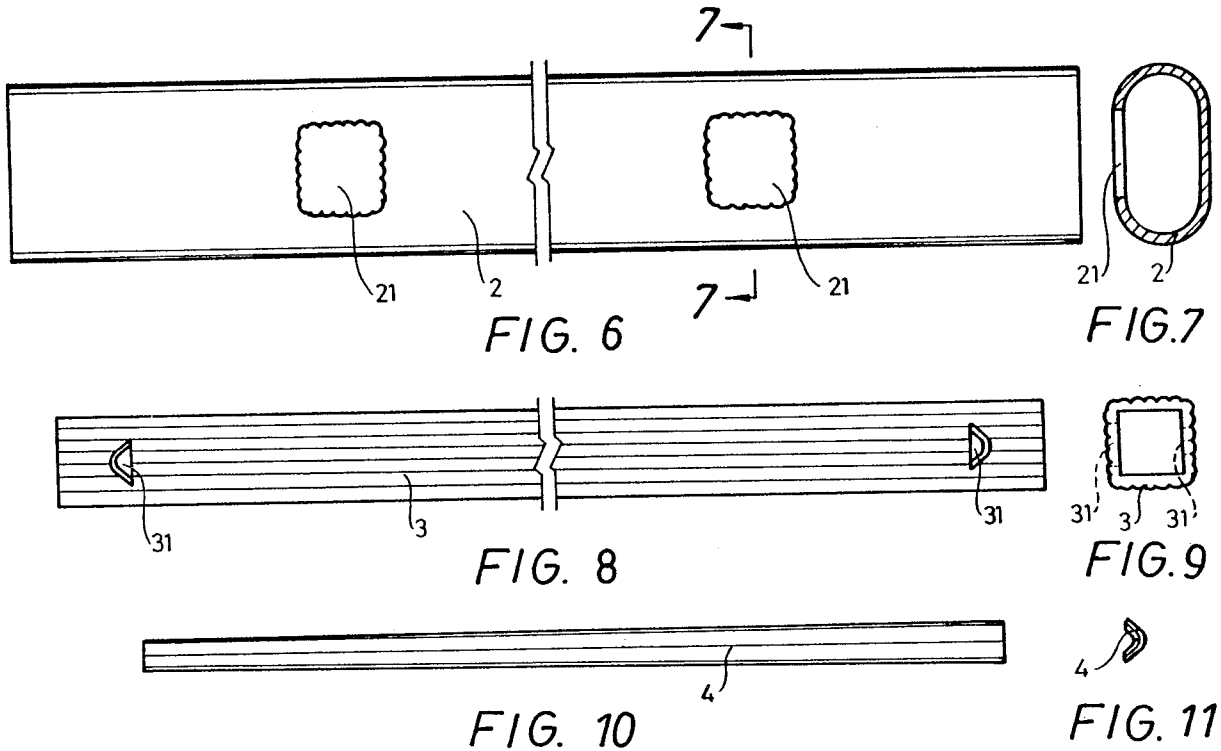
FIG. 6 is a structural view of the upright in accordance with the present invention.
FIG. 8 is a structural view of the rung in accordance with the present invention.
FIG. 9 is a side view of the rung in accordance with the present invention.
FIG. 10 is a structural view of the stopping strip in accordance with the present invention.
FIG. 11 is a side view of the stopping strip in accordance with the present invention.
Figure 12:
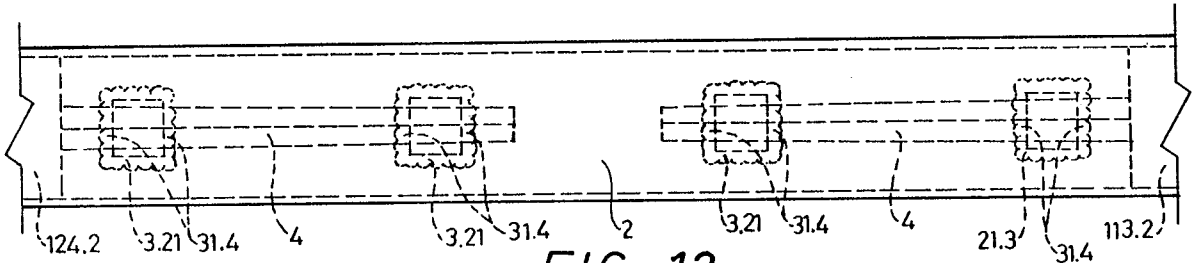
FIG. 12 is a side view of one section of this ladder showing the insertion of the stopping strip into the rungs in accordance with the present invention.

The upright 2 shown in FIGS. 6 and 7 is made of aluminum extruded into a hollow tube with four equally spaced holes 21. Rungs 3 as described below are inserted into the holes therein connecting two uprights 2.

The arm 113 or 124 of either the male or the female hinge of the hinged joint 1 is inserted into the hollow space at the end of the upright 2. The upright and the hinged joint are tightly held together by pressing the ends of the upright 2 after insertion of the hinged joint 1.

The rung 3 shown in FIG. 8 is a square hollow tube of extruded aluminum. Its ends can be inserted in the holes 21 of the uprights 2. An isosceles triangle hole 31 is separately bored near the end for the insertion of a stopping strip 4 (FIG. 10) to anchor the rungs 3 with the uprights. In addition, lengthwise protruding lines are set on the face of each rung 3 to prevent slipping.

Figure 13:
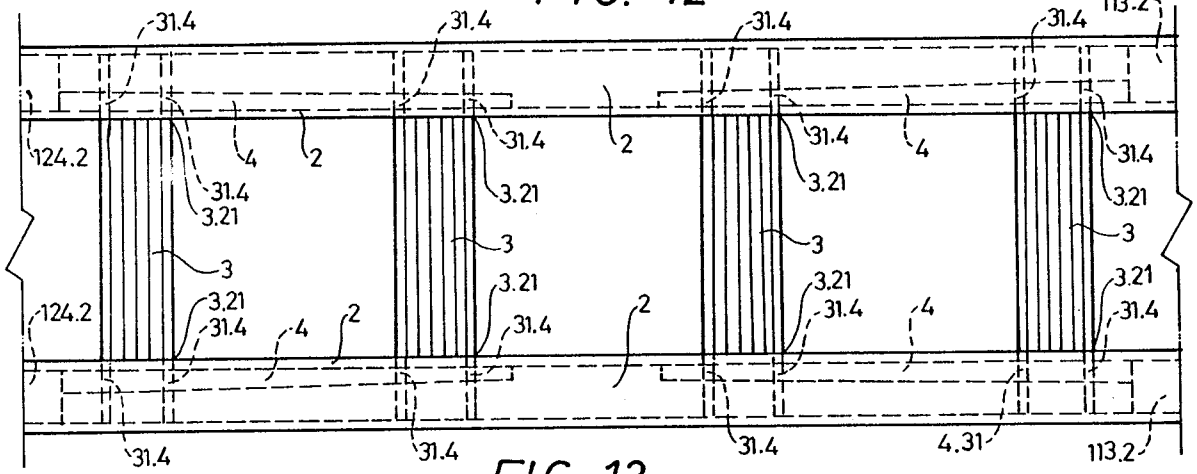
FIG. 13 is a front view of one section of this ladder showing the insertion of the stopping strip into the rungs in accordance with the present invention.
Figure 14:
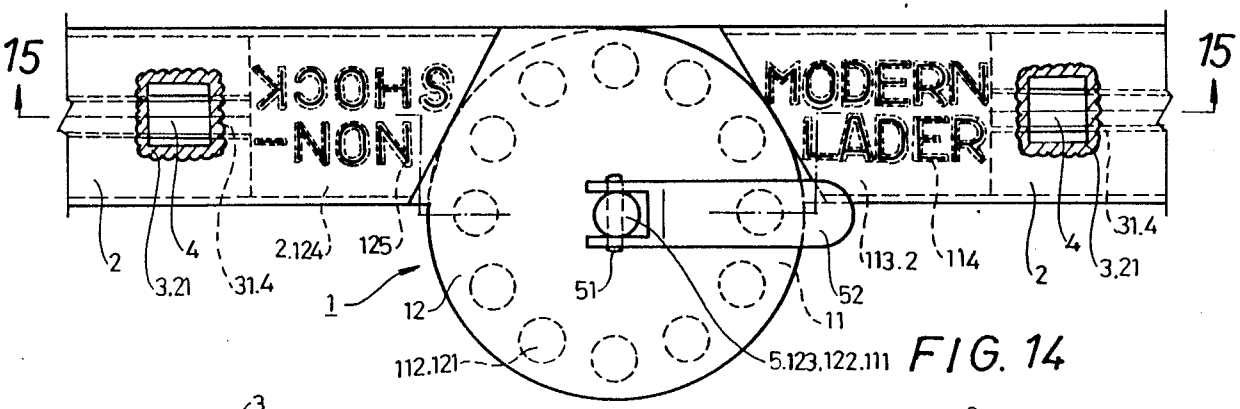
FIG. 14 is a side view of a hinged joint showing the lever handle in a locked position.
Figure 15:
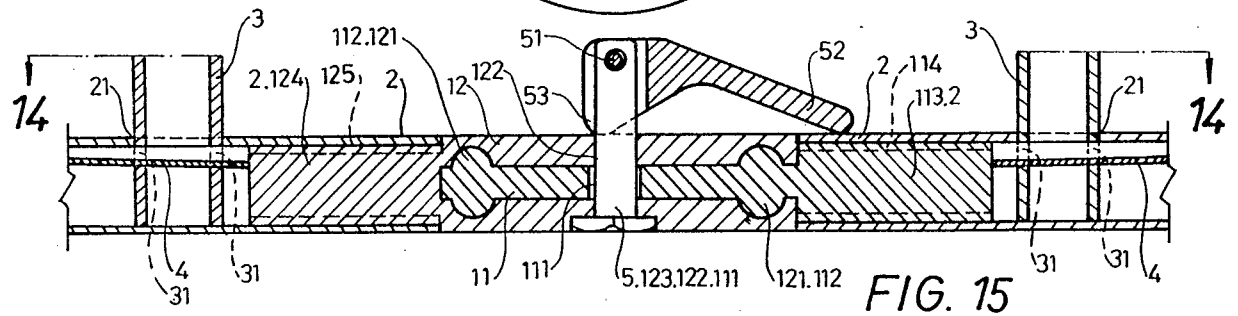
FIG. 15 is a cross-sectional view taken along line 15—15 of FIG. 14.
Figure 16:
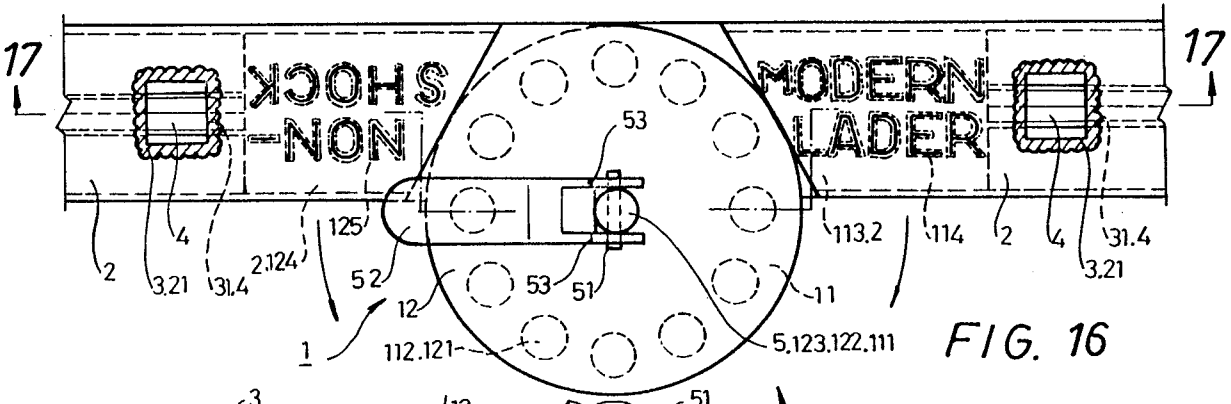
FIG. 16 is a cross-sectional view of taken along line 16—16 of FIG. 17.
Figure 17:
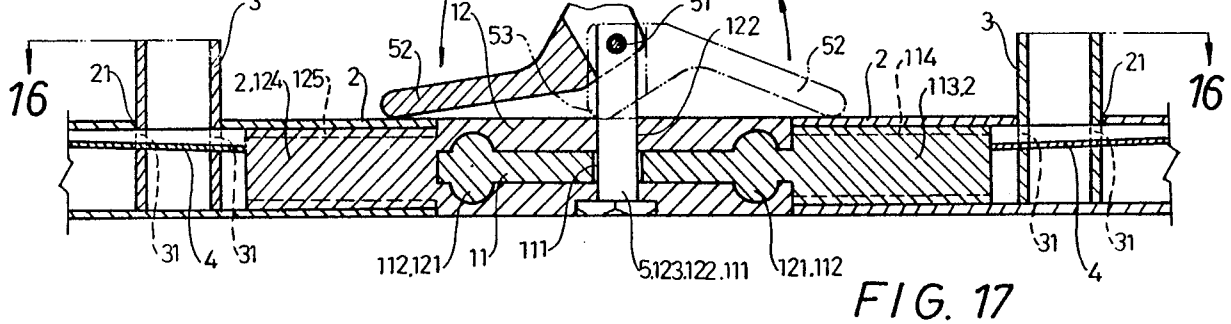
FIG. 17 is a cross-sectional view taken along line 17—17 of FIG. 16.

The stopping strip 4 shown in FIGS. 10 and 11 is long enough to penetrate the holes 31 of two adjoining rungs 3. Strip 4 has a bent cross-section and a tapering length so that one of its ends is wider than the other. The narrower end is to be inserted through the hole 31 of the first rung 3 and to stop after it passes the hole 31 of the second rung 3. The wider end is of such width that it stops before passing the hole 31 of the first rung 3. The combining of said strip 4 with the holes 31 is effected by means of its bent sides. After strip 4 is set in place, the male hinge 11 or the female hinge 12 is inserted into the hollow space of the upright 2. A pressing process is used to press in the same words 114, or 125 as on the male or female hinge, onto upright 2. The process keeps the hinge 11 or 12 from separating from the upright 2. After the hinge is pressed in place with upright 2, the end of the arms 113, 124 of the male or the female hinges 11, 12 as shown in FIGS. 13 and 14 prevents strip 4 from coming out of the rung holes 31. Because of this arrangement, strip 4 cannot come out of the holes 31 of rungs 3 for any configuration of the ladder, thus securing rungs 3 in place with upright 2.

After the male hinge 11 and the female hinge 12 are engaged with each other, a bolt 5 is inserted in the round hole 122 to hold both hinges 11, and 12 in place. The bolt 5 has a pin hole for a pin 51 to insert through a lever handle 52, which rotates using pin 51 as a pivot. When the proper angle between two uprights is attained, the protruding hemispheres 112 of the male hinge 11 engage with the dented hemisphere holes 121 of both round sections of the female hinge. The lever handle 52 is then locked to press the protruding end 53 and the bolt 5 head against the round sections of the female hinge 12, thereby locking the male and female hinges.

Figure 19:
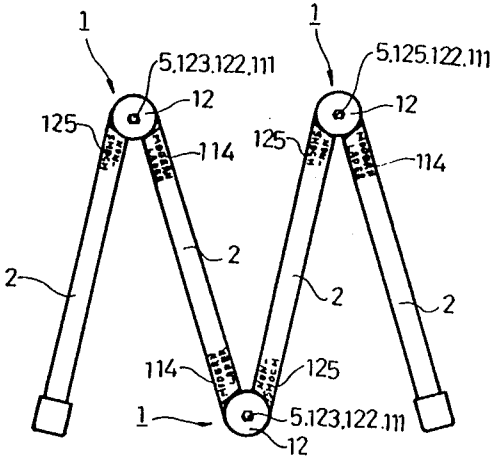
FIG. 19 is an elevational view of this ladder folded to form an M shape in accordance with the present invention.
Figure 18:
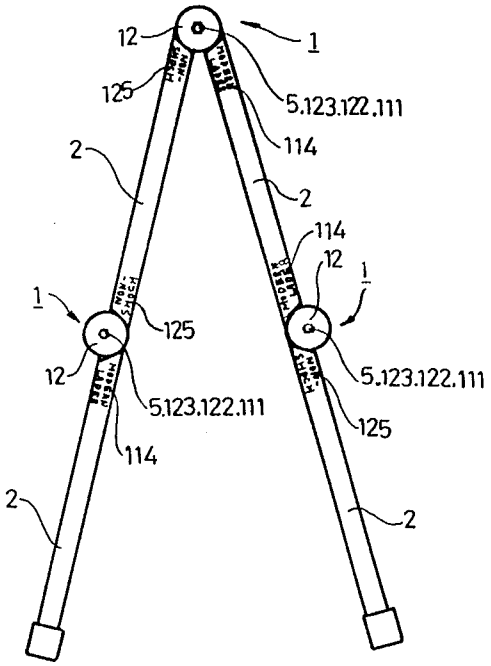
FIG. 18 is an elevational view of this ladder folded to form a reversed V shape in accordance with the present invention.

The lever handle 52 can be unlocked by rotating it in the opposite direction thus releasing bolt 5 and the protruding end 53 from the face of the female hinge 12. When the female hinge 12 is not pressed against the male hinge 11, the hinges can rotate relative to each other. The user can then adjust the relative angle between two straight sections until the desired angle is attained. The lever handle is again locked in place to tighten the male hinge 11 with the female hinge 12. The ladder can thus be adjusted into a straight ladder, a reversed V shape or an M shape as shown in FIGS. 1, 18 and 19 respectively.

Figure 20:
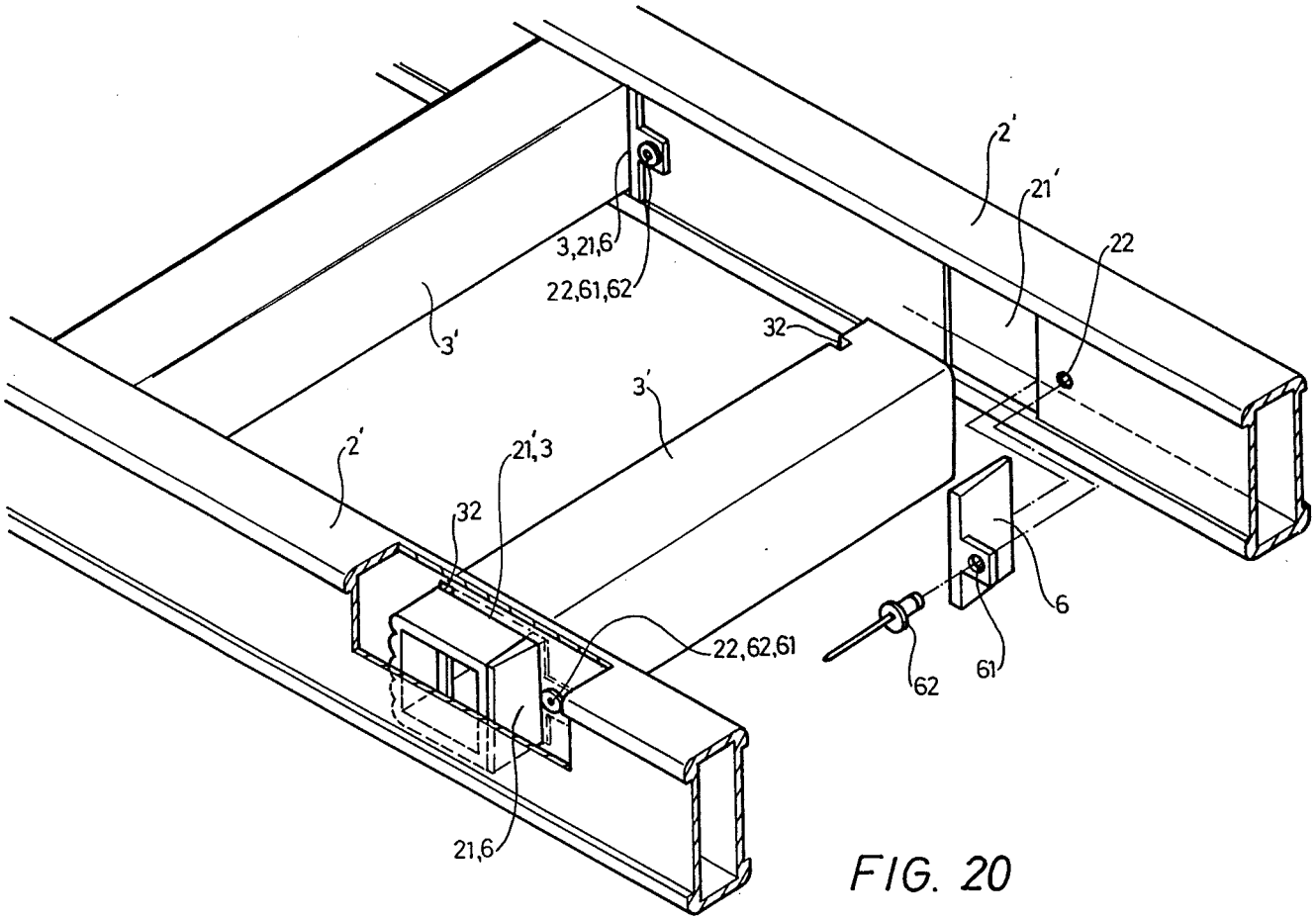
FIG. 20 is a perspective view of the second method of the combination of the upright with the rung in accordance with the present invention.

FIG. 20 shows a second method of combining the rungs 3' with uprights 2'. The upright 2', in this case, is a hollow rectangular tube with holes 21' of the same size as the rungs 3'. Each rung 3' has a straight groove 32 cut near both ends on one face. The groove 32 is a little wider than the thickness of the wall of each upright 2' so that the groove 32 can be tucked into the wall of the upright 2' after the rung 3' is inserted in the upright 2'. Then a stopper 6 having a hole 61 is inserted under rung 3' into the upright 2'. The hole 61 is aligned with the hole 22 in the upright 2' and a nail 62 is nailed in through both holes 61 and 22 to secure the stopper 6 in its place. Since rung 3' is tucked into upright 2' at groove 32, rung 3' is secured with upright 2'.

Figure 21:
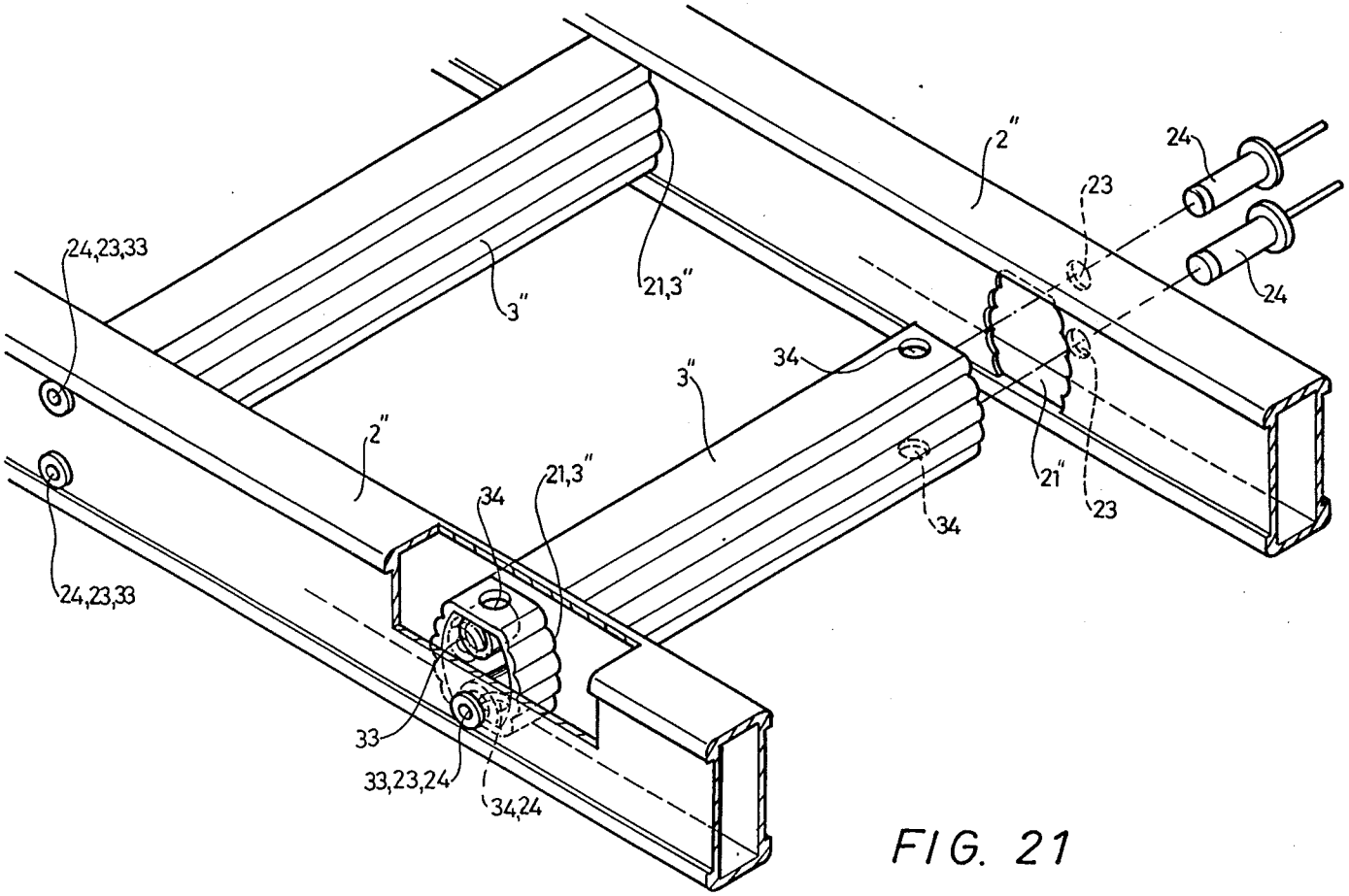
FIG. 21 is a perspective view of the third method of the combination of the upright with the rung in accordance with the present invention.

FIG. 21 shows a third method of combining rungs 3'' with upright 2''. The upright 2 in this case is a hollow rectangular tube having equally spaced holes 21'' in one of its sides. Two holes are bored on the other side of the upright 2''. The rungs 3'' in this case is a hollow tube containing two auxiliary small round tubes 33. A hole 34 is drilled on the top face and the bottom face near both ends. After the rung 3'' is inserted in the upright 2'', the holes 34 are hidden inside the hollow space of the upright 2''. Then a nail 24 is nailed in the hole 23 of the upright 2'' and the small round tube 33. The part of the nail 24 entering the small round tube 33 swells up and protrudes out of the hole 34, thereby securely combining the rung 3'' with the upright 2''.

What is claimed is:

1. A folding ladder comprising:

a plurality of hinged joints, each said hinged joint consisting of a male hinge, a female hinge and a coupling means for selectively coupling said male hinge and said female hinge immovably together, said hinges both being made of an electrically insulating material and having a common center axis, said male hinge having a male arm with two sides in which insignia has been indented, a cylindrical member at an end of said male arm having opposite circular faces with the center axis through said circular faces, and a plurality of protruding hemispheres set concentrically and evenly spaced on said circular faces about the center axis, said female hinge having a female arm with two sides in which insignia has been indented, opposed circular members at an end of said female arm having inner faces separated by a distance sufficient to receive said cylindrical member therebetween and with the center axis through said inner faces, and a plurality of indented hemispheric holes set concentrically and evenly spaced in said inner faces about the center axis which receive a corresponding said hemisphere when said cylindrical member is received between said circular members;

uprights made of extruded aluminum tubes and provided with rung holes along one tube side, said uprights having open ends in which a said arm of one of said male and female hinges is received to join one said upright to another by a said hinged joint, said ends also including indented insignia pressed therein after insertion of said arm and corresponding to and mating with the insignia of said arm at locations overlying said insignia of said arm whereby said arm is securely held in said end by the indented insignia of said end; and rungs made of extruded aluminum tubes with lengthwise protruding lines set along the length thereof to prevent slipping, said rungs being received in opposed rung holes of parallel said uprights.

2. A folding ladder as claimed in claim 1 wherein said coupling means for each said hinged joint includes:

a bolt which is received in a center hole provided along the center axis and including a head which engages one of said circular members and a distal end which extends beyond the other of said circular members, and a lever handle and an associated attaching means which attaches said lever handle to the distal end of said bolt for rotation about an axis perpendicular to a longitudinal axis of said bolt from one side of said bolt to the other, said lever handle including a camming portion (a) which engages the other of said circular members when said lever handle is moved to one side of said bolt to lock said hemispheres in respective said hemispheric holes and thus to prevent relative rotation of said male and female hinges and (b) which does not engage the other of said circular members when said lever handle is moved to the other side of said bole to permit adjustment of one upright relative to an adjacent said upright by allowing relative rotation of said male and female hinges.

3. A folding ladder as claimed in claim 2 wherein the distal end of said bolt includes a bolt pin hole; wherein said lever handle includes a handle portion and a U-shaped portion having spaced apart flanges provided with opposed handle pin holes and opposed camming surfaces which form said camming portion; and wherein said attaching means is a pin passing through aligned said bolt and handle pin holes with said handle pin holes and said camming surfaces arranged such that said camming surfaces are located on an opposite longitudinal side of said bolt from said handle portion when said lever handle is moved to the locked position.

4. A folding ladder as claimed in claim 1 wherein said rungs include rung ends disposed in a respective said upright, and triangular holes provided in said rung ends; and further including a respective tapered stopping strip which is received longitudinally in a respective said upright and which passes through said triangular holes of said rung ends located in the respective said upright.

5. A folding ladder as claimed in claim 1 wherein each said rung includes opposite rung ends disposed in a respective said upright and a respective groove located adjacent a respective said rung end along one side of said rung whereby said rung end is inserted in an associated said rung hole of an associated said upright with said tube side of said upright received in said groove; and further including for each rung end a stopper which is inserted between an opposite side of said rung from said one side and said tube side of said upright to prevent withdrawal of said tube side from said groove, and a holding means for securely holding said stopper in place.

6. A folding ladder as claimed in claim 1 wherein each said rung includes opposite rung ends disposed in a respective said upright, each said rung end including opposed rung sides, a respective rung tube provided along each opposed rung side, and a respective rung aperture provided in each said opposed rung side adjacent a respective said rung tube; wherein said upright includes a plurality of pairs of upright apertures located along a second tube side opposite said one tube side such that said upright apertures align with said rung tubes of a respective said rung end; and further including expansion members, each said expansion member having a head and a body, said body being inserted through a respective said upright aperture and into a respective said rung tube until said head contacts said second tube side and said body being expanded so as to protrude into a respective said rung aperture.

* * * * *